US006729522B2

(12) United States Patent
Hempfling et al.

(10) Patent No.: US 6,729,522 B2
(45) Date of Patent: May 4, 2004

(54) FASTENER DRIVING TOOL HAVING IMPROVED BEARING AND FASTENER GUIDE ASSEMBLIES

(75) Inventors: Dave C. Hempfling, Chicago, IL (US); Larry Reinebach, Glen Ellyn, IL (US); Dan McAuley, Santa Ana, CA (US)

(73) Assignee: Illinois Tool Works Inc., Glenview, IL (US)

( * ) Notice: Subject to any disclaimer, the term of this patent is extended or adjusted under 35 U.S.C. 154(b) by 373 days.

(21) Appl. No.: 09/783,430

(22) Filed: Feb. 14, 2001

(65) Prior Publication Data

US 2002/0108995 A1 Aug. 15, 2002

Related U.S. Application Data

(60) Provisional application No. 60/264,637, filed on Jan. 26, 2001.

(51) Int. Cl.[7] ..... B25C 5/02

(52) U.S. Cl. ..... 227/119; 227/139; 227/140; 227/146; 81/57.37

(58) Field of Search ..... 227/119, 136, 227/139, 140, 146, 15; 81/57.37

(56) References Cited

U.S. PATENT DOCUMENTS

| | | | | |
|---|---|---|---|---|
| 2,374,558 A | | 4/1945 | Moore | |
| 3,587,683 A | * | 6/1971 | Bangerter | 81/430 |
| 3,960,191 A | * | 6/1976 | Murray | 221/289 |
| 3,965,950 A | * | 6/1976 | MacDonald | 81/455 |
| 3,973,605 A | * | 8/1976 | DeCaro | 227/10 |
| 4,236,555 A | * | 12/1980 | Dewey | 221/179 |

(List continued on next page.)

FOREIGN PATENT DOCUMENTS

| | | |
|---|---|---|
| DE | 41 32 504 | 4/1992 |
| DE | 92 09 745 | 9/1992 |
| EP | 0 338 554 | 10/1989 |
| FR | 2 613 266 | 10/1988 |
| FR | 2 712 224 | 5/1995 |

OTHER PUBLICATIONS

ITW Buildex, AUTOTRAXX, Catalog Page.

*Primary Examiner*—Rinaldi I. Rada
*Assistant Examiner*—Louis Tran
(74) *Attorney, Agent, or Firm*—Lisa M. Soltis; Mark W. Croll; Donald W. Breh

(57) ABSTRACT

A fastener driving tool includes a driver having a driver shaft extending therefrom, a first extension member operably connected to the driver and a second extension member operably connected to the first extension member. The tool is for use on roof deck panels. The second extension member slidingly engages the first extension member between a loading position and a driving position. A bearing assembly operably connects the first and second extension members. The bearing assembly is formed from a non-metallic, low-friction material. A portion of the bearing assembly is mounted to one of the first and second extension members for sliding engagement with the other extension member and is disposed to prevent direct contact of the first and second extension members with one another. A fastener receiving member is mounted to the second extension member for receiving fasteners when in the loading position and for supporting and releasing the fasteners when in the driving position. The fastener receiving member includes a cradle having a main body portion and a pair of legs extending from the main body portion diverging downwardly and outwardly. The cradle is configured for positioning on the roof panel, straddling raised portions of the panel for aligning the tool therealong.

40 Claims, 4 Drawing Sheets

U.S. PATENT DOCUMENTS 4,295,394 A * 10/1981 DeCaro ..... 81/451
4,354,403 A * 10/1982 Boegel et al. ..... 81/453
4,397,412 A * 8/1983 Dewey ..... 227/119
4,510,826 A * 4/1985 Marks ..... 81/57.37
5,193,729 A 3/1993 Dewey et al.
5,199,506 A 4/1993 Dewey et al.
5,199,625 A 4/1993 Dewey et al.
5,295,774 A 3/1994 Roberts
5,904,284 A * 5/1999 Lin ..... 227/11
5,921,454 A * 7/1999 Larson et al. ..... 227/107
5,992,274 A 11/1999 Lammers
6,244,141 B1 * 6/2001 Han ..... 81/453
6,296,064 B1 * 10/2001 Janusz et al. ..... 173/11

* cited by examiner

FASTENER DRIVING TOOL HAVING IMPROVED BEARING AND FASTENER GUIDE ASSEMBLIES

This application claims the benefit of provisional application No. 60/264,637 filed on Jan 26, 2001.

BACKGROUND OF THE INVENTION

This invention pertains to a fastener driving tool having improved bearing and guide assemblies. More particularly, the present invention pertains to a fastener-driving tool having non-metal contacting bearing assemblies and an enhanced aligning nosepiece guide assembly.

Fastener driving tools are well known in the art. Such tools are typically powder-actuated or electric-actuated tools for driving fasteners through a surface, such as a metal deck or metal roof. The fasteners that are driven are of a known type that include a shank having a self-tapping, self-driving or self-drilling tip at one end and head integral with the other end of the shank. Typically, a sealing washer is positioned on the shank with an interference fit.

Known fastener-driving tools generally include a driver such as a powder actuated or an electric-actuated driver that is mounted to telescoping tubes. A first tube (upper or outer tube) is stationary relative to the driver and a second (lower or inner tube) telescopes relative to the upper tube. A shaft is mounted to the driver and extends through the tubes. The lower tube telescopes relative to the upper tube to permit movement of the driver shaft relative to a distal end of the lower tube. An end of the shaft includes, for example, a hex or socket-like element to engage the fastener head for driving. The lower tube telescopes to permit movement between a retracted position and a contracted position. In the retracted or extended position, a fastener is loaded onto an end of the shaft for driving into the surface. In the contracted position, the fastener is driven from the tool outwardly, through the distal end of the lower tube, into the surface.

Known fastener driving tools include a spring positioned between the tubes to urge the tubes and thus the tool into the retracted or loading position. In known driving tools, the lower tube is fitted immediately within the upper tube. Although this assures proper alignment of the tubes relative to one another and straight movement of the fastener, there is surface-to-surface contact of the tubes. In that these tubes are formed of metal this produces metal-to-metal contact between the tubes and can result in high frictional forces and possibly binding of the tubes.

Generally, a stop is positioned on the end of the upper tube that cooperates with a stop positioned along the length of the lower tube. This limits that travel of the tubes relative to one another and assures that the fastener is properly driven into the surface. That is, the stops are positioned relative to one another so that the fastener is driven a predetermined amount into the surface.

Known fastener driving tools include a nosepiece assembly that supports the fastener prior to and as it is engaged by the driver shaft (e.g., socket-like element). An opening in the nosepiece provides a track or path through which the fastener is driven from the tool. One drawback to known nosepiece assemblies is that while the nosepiece is relatively large, the opening through which the fastener is driven is relatively small. In that some types of roofing systems have preformed holes for receiving the fasteners, it is only with skill, practice and close inspection that the fastener opening is properly aligned with the roof deck panel hole. Other types of roofing systems require fastening roof panels, without these preformed holes, to one another and/or to underlying structural members.

In addition, many such metal roofing systems are formed having a corrugated profile defined by "peaks" and "valleys". For those systems that have the preformed holes, the holes are typically formed on the peak portion of the corrugations. This makes it even more difficult to align the tool while maintaining it balanced on top of the corrugation while driving the fastener.

Accordingly, there is a need for a fastener driving tool that has an improved bearing surface to eliminate the problems associated with metal-to-metal sliding tube contact. Desirably, such a tool includes an enhanced fastener aligning and guide assembly to facilitate proper positioning of the fastener over the surface into which the fastener is driven. Most desirably, these enhanced features are provided in a tool that permits the tool operator to use the tool standing in an erect or near-erect stance to reduce operator fatigue.

BRIEF SUMMARY OF THE INVENTION

A fastener driving tool for driving fasteners into a workpiece is for use by an operator in a substantially erect position. The tool is configured for use on roof panels to drive fasteners into the panels for panel to panel and panel to structural applications. The panels have a corrugation-like profile defining a peak, a pair of valleys adjacent to the peak and respective walls extending between the peak and the adjacent valleys. Holes may be pre-formed in the panels, along the peak, for fastening the panels to the underlying structure or for joining panels to one another.

The tool includes a driver, such as an electric motor, telescopic extension members and a fastener receiving member. The telescopic extension members permit driving the fasteners into the roof panel. The fastener receiving member receives a fed fastener, supports the fastener during loading and releases the fastener as it is driven into the roof panel.

The driver has a driver shaft extending therefrom. The first extension member is operably connected to the driver and the second extension member is operably connected to the first extension member. In a current embodiment, the extension members are formed as tubes, with the first tube being a upper tube and the second member being a lower tube. The lower tube slidingly engages the upper tube between a loading position to load fasteners into the tool and a driving position to drive the fasteners from the tool into the roof panels.

A bearing assembly operably connects the upper and lower tubes. The bearing assembly is formed from a non-metallic, low-friction material, such as an acetal resin. A portion of the bearing assembly is mounted to one of the upper and lower tubes for sliding engagement with the other tube. The bearing assembly is positioned to prevent direct contact of the tubes with one another.

In one embodiment, the bearing assembly includes an upper tube bearing mounted to a lower end of the upper tube for slidingly engaging the lower tube. Preferably, the upper tube bearing including a sleeve portion mounted to the upper tube and a bearing portion extending transverse to and inwardly of the sleeve portion for contact with the lower tube.

The bearing assembly can further include a driver shaft guide mounted to the lower tube at about an upper end thereof. The driver shaft guide carries an upper tube bearing surface for slidingly engaging the upper tube. The upper tube bearing surface and the upper tube bearing maintain the upper and lower tubes concentric with one another during use.

The fastener receiving member receives fasteners when in the loading position and supporting and releases the fasteners when in the driving position. The fastener receiving member is mounted to the lower tube. The fastener receiving member includes a cradle having a main body portion and a pair of legs extending from the main body portion diverging downwardly and outwardly from the main body, symmetrical to one another.

The main body defines an upper inside surface extending between and contiguous with the legs, and an opening through the main body portion for passage of the fastener. The cradle is configured for positioning on the panel, straddling the peak with the upper inside surface resting adjacent the peak and the legs extending into the valleys for aligning the opening in the main body portion with a desired location on the roof panel (e.g., the panel hole).

In one embodiment, the cradle includes an aligning member having a jaw assembly that includes first and second jaw pivotal jaw elements mounted thereto. The jaw elements pivot between a closed position wherein the jaw elements abut one another and support a fastener and an open position wherein the jaw elements are pivoted away from one another by the fastener driven therethrough. The jaw elements are mounted to the cradle by pivot pins.

Preferably, an upper guide is mounted to the cradle. The upper guide is movable between a loading position that corresponds to the closed position of the jaw elements and a driving position that corresponds to the open position of the jaw elements. The upper guide includes a locking member for interfering with pivoting of the jaw elements when the upper guide is in the loading position and for disengaging from the jaw elements when the upper guide is in the driving position.

The jaw elements are configured each defining one-half of a cone. When together, the jaw elements define a nadir. In a current embodiment, the nadir extends through the cradle opening beyond the upper inside surface, so that the nadir rests on a desired location (e.g., "falls" into a roof panel hole).

Alternately, the cradle is formed having a viewing opening formed in at least one of the legs. An aligning marker can be formed as a stylus that extends inwardly of the viewing opening or as indicia on the one of the legs.

These and other features and advantages of the present invention will be apparent from the following detailed description, in conjunction with the appended claims.

BRIEF DESCRIPTION OF THE SEVERAL VIEWS OF THE DRAWINGS

The benefits and advantages of the present invention will become more readily apparent to those of ordinary skill in the relevant art after reviewing the following detailed description and accompanying drawings, wherein.

DETAILED DESCRIPTION OF THE INVENTION

Figure 1:
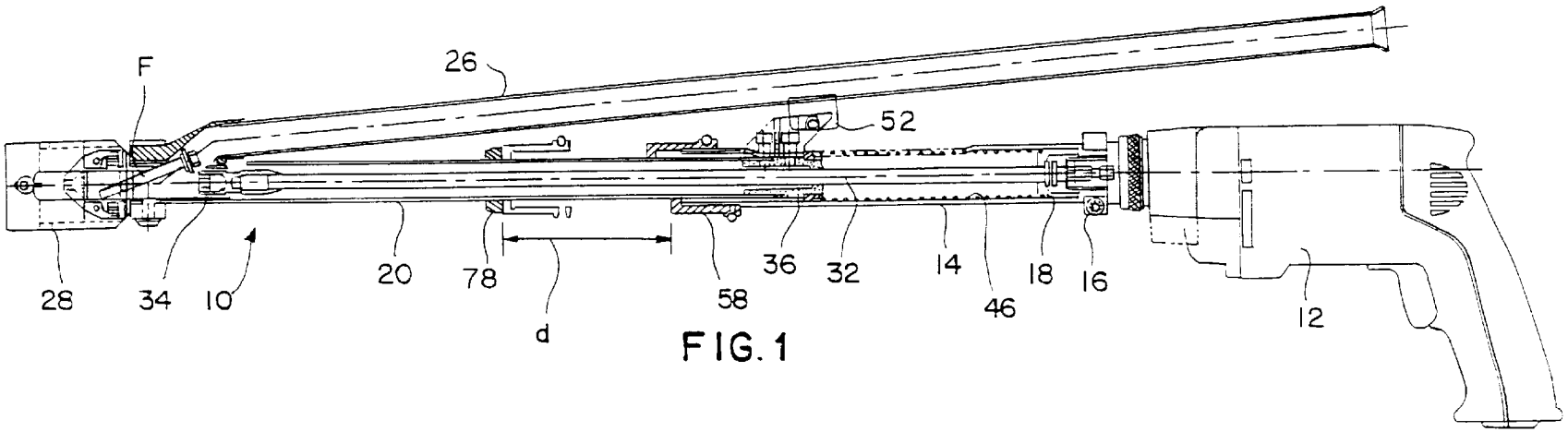
FIG. 1 is a front view, shown in partial cross-section, of a fastener driving tool embodying the principles of the present invention showing the tool in the retracted or loading position, in which the outer tube bearing is shown engaging the inner tube stop in phantom lines.

While the present invention is susceptible of embodiment in various forms, there is shown in the drawings and will hereinafter be described presently preferred embodiments with the understanding that the present disclosure is to be considered an exemplification of the invention and is not intended to limit the invention to the specific embodiments illustrated. It should be further understood that the title of this section of this specification, namely, "Detailed Description Of The Invention", relates to a requirement of the United States Patent Office, and does not imply, nor should be inferred to limit the subject matter disclosed and claimed herein.

Referring now to the figures and in particular to FIG. 1, there is shown a fastener driving tool 10 embodying the principles of the present invention. The tool 10 includes, generally, a driver 12 such as the illustrated electric, rotating driver 12. An outer, upper tube 14 is fixedly mounted to the driver 12 by, for example, the exemplary illustrated clamp 16. The upper tube 14 is mounted to the driver 12 at a driver cap assembly 18.

A lower, inner tube 20 is telescopically mounted to the upper tube 14. The lower tube 20 slides freely within a lower portion of the upper tube 14, as will be described in more detail below. A bottom or distal end 22 of the lower tube 20 terminates at a juncture, as indicated at 24, with a feed tube 26. The feed tube 26 is mounted to the lower tube 20 for feeding individual fasteners F through the feed tube 26 into the distal end 22 of the lower tube 20. A nosepiece assembly 28 is mounted to an end 30 of the tool 10 at about and adjacent the juncture 24 of the feed tube 26 and lower tube 20. The nosepiece assembly 28 supports the fasteners F as they are fed into the lower tube 20 and are driven from the tool 10.

Figure 2A:
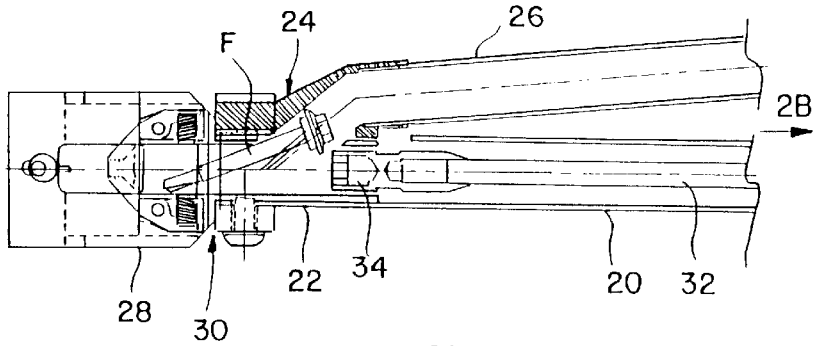
FIGS. 2A–2C are partial, enlarged cross-sectional views of the fastener driving tool of FIG. 1, the partial figures shown for ease of illustration.

A driver shaft 32 extends from the driver 12 through the upper and lower tubes 14, 20. A bottom end of the driver shaft 32 includes a fastener engaging element 34, such as the illustrated hexagonal socket-like element for engaging the fastener F head. When the tool 10 is in the retracted (i.e., loading) state, as seen in FIGS. 1 and 2A, the fastener engaging element 34 extends just beyond the distal end 22 of the lower tube 20. This positioning facilitates loading the fastener F. When the tool 10 is in the contracted (i.e., driving) state, the fastener engaging element 34 extends into the nosepiece assembly 28 to drive the fastener F from the tool 10 into the workpiece.

A driver shaft guide 36 is positioned at and mounted to an upper end 38 of the lower tube 20. The guide 36 includes an inner circumferential shoulder 40. A driver shaft bearing 42 is mounted on the inner shoulder 40 providing a bearing surface for the driver shaft 32. The guide 36 further includes an outer shoulder 44 at an outer periphery, generally opposing the inner shoulder 40. A spring 46 is positioned and extends between the outer shoulder 44 and the driver cap assembly 18. The spring force is exerted against the lower tube 20 (by connection to the guide 36) and the driver cap 18, thus biasing the tubes 14, 20 into the retracted state. In a current embodiment, the guide outer shoulder 44 includes a spring seat bearing 48 for engaging the spring 46. The spring seat bearing 48 includes an upper tube bearing surface 50 for slidingly engaging the upper tube 14.

In a present embodiment, the driver shaft guide 36, driver shaft bearing 42 and outer shoulder portion/spring seat bearing 44/48, including the outer tube bearing surface 50, are formed from a suitable, low friction polymeric material, such as DELRIN®, which is commercially available from E. I. du Pont de Nemours and Company. DELRIN® is an acetal resin based material (more particularly polyoxymethylene) that exhibits numerous advantageous characteristics, including high tensile strength, impact resistance, and stiffness, as well as fatigue endurance, resistance to moisture and chemicals, dimensional stability and natural lubricity. Those skilled in the art will recognize other suitable materials for use in the present invention, which other materials are within the scope and spirit of the present invention.

Figure 2B:
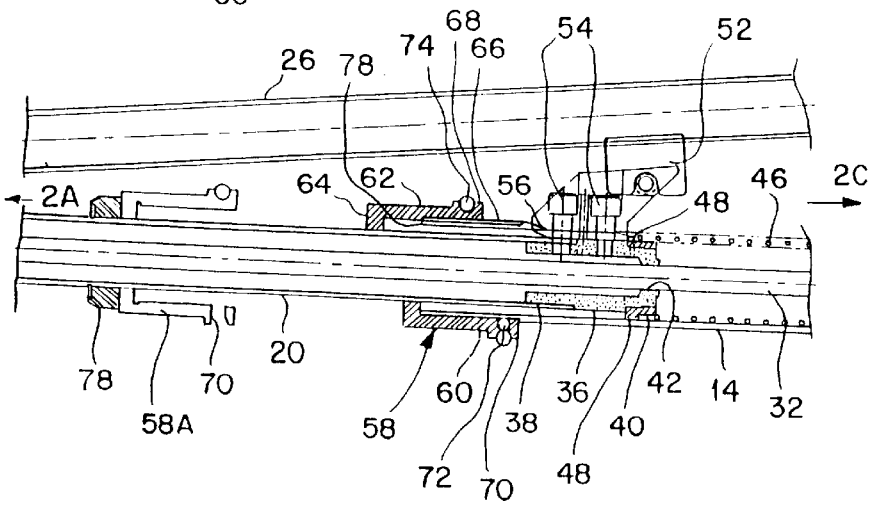
Figure 2C:
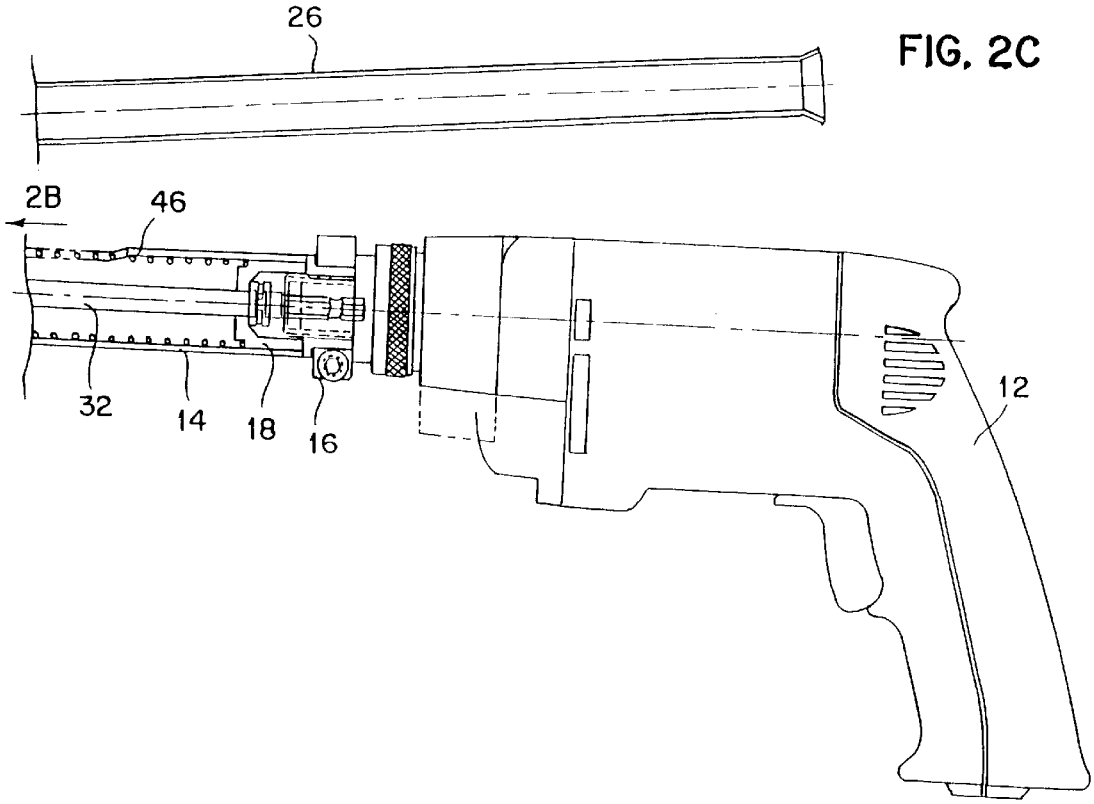

As described above, the feed tube 26 is joined with the lower tube 20 at the distal end 22 of the lower tube 20. As best seen in FIG. 2A, the feed tube 26 enters the lower tube 20 at an angle so that the fasteners F traverse smoothly from the feed tube 26 into the nosepiece 28. Referring to FIG. 2B, a feed tube mount 52 is positioned on the lower tube 20 and secures the feed tube 26 to the lower tube 20. The feed tube mount 52 includes a pair of fasteners 54 that extend through an opening 56 in the wall of the upper tube 14 and into the drive shaft guide 36.

Unlike known fastener driving tools, the present tool 10 includes an upper tube bearing assembly 58 mounted to the upper tube 14 for guiding that tube 14 along the lower tube 20. The bearing 58 is mounted to an outer surface 60 of the upper tube 14 and includes a sleeve portion 62 and a bearing portion 64. In a current embodiment, the bearing portion 64 extends from an end of the sleeve portion 62 generally transverse thereto and contacts the lower tube 20. In one configuration, the sleeve portion 62 is threadedly mounted to the upper tube 14 at threaded region 66. In a present embodiment, the upper tube bearing 58 is also formed from an acetal resin, such as DELRIN®, or a like suitable, low friction material.

Referring now to FIGS. 1 and 2B, the bearing assembly 58, shown cross-hatched, illustrates the bearing 58 when the tool 10 is in the retracted or loading position. The bearing assembly 58 shown non-cross-hatched at 58*a* illustrates the bearing 58 when the tool 10 is in the contracted or driving position. It must also be noted that although the bearing assembly 58 appears to be of a split arrangement, it in fact is not. That is, the bearing halves symmetrically oppose one another and form a single bearing with a single, circular (not skewed or elliptical) bearing portion 64.

The sleeve portion 62 includes an outer collar 68 having a groove 70 formed therein into which one or more pliable spheres 72 are fitted to maintain the sleeve portion 62 in a predetermined location along the upper tube threads 66. In a current embodiment, the spheres 72 are also formed from a polymeric material, such as DELRIN® acetal resin. An O-ring 74 can be positioned around the spheres 72 to maintain the spheres 72 securely in place along the upper tube threads 66.

As can be seen from FIGS. 1 and 2B, a gap 76 is defined between the upper and lower tubes 14, 20. The gap 76 spaces the tubes 14, 20 from one another to prevent metal-to-metal contact between the tubes 14, 20. The gap 76 is maintained annular by the bearing portion 64 of the upper tube bearing assembly 58 (which is mounted to the upper tube 14 and contacts the lower tube 20) and the driver shaft guide 36 upper tube bearing surface 50. In this manner, the upper and lower tubes 14, 20 are maintained spaced from one another by a pair of longitudinally spaced, circumferential bearing surfaces 50, 64 that assure that the tubes 14, 20 are maintained concentric with one another along their lengths. In addition to the spacing provided, these bearing surfaces 50, 64 provide low friction, non-binding movement of the tubes 14, 20 relative to one another. This arrangement further assures that there is no metal-to-metal contact between the upper and lower tubes 14, 20 during operation of the tool 10.

Stops 78 are fixed to an outer surface of the lower tube 20 distally from the upper tube bearing 58. The stops 78 cooperate with and engage the bearing portion or leg 64 of the upper tube bearing 58 to set a predetermined amount of travel d of the lower tube 20 relative to the upper tube 14. The amount or distance of travel d is set by threadedly engaging the upper tube bearing 58 along the threaded region 66 of the upper tube 14. This predetermined amount of travel d limits the travel of the driver shaft 32 and fastener engaging element 34 into the nosepiece 28, and subsequently, the distance that the fastener F is driven out of the tool 10 into the workpiece. As will be appreciated from a study of the drawings, the distance that the fastener F is driven by the tool 10 is set by the distance or travel d between the upper tube bearing 58 and the stops 78. As will also be appreciated by those skilled in the art, it is important that the fasteners F be driven into the workpiece surface (such as a roofing deck) a predetermined amount. Under-driving the fastener results in improperly securing the roof deck panels to one another, while over-driving the fastener can result in an improper seal between the fastener and the roof deck panels.

In a present tool 10, the travel or distance d can be set between 3.125 inches and 3.625 inches. This corresponds to the depth to which commonly used roofing deck fasteners are specified to be driven. As set forth above, this travel is set by threadedly engaging or disengaging the upper bearing assembly 58 from the upper tube threads 66. It will be recognized by those skilled in the art that variations can be made to the tool 10 to provide one or more different ranges of travel for the tool 10, which other ranges are within the scope and spirit of the present invention.

Figure 5:
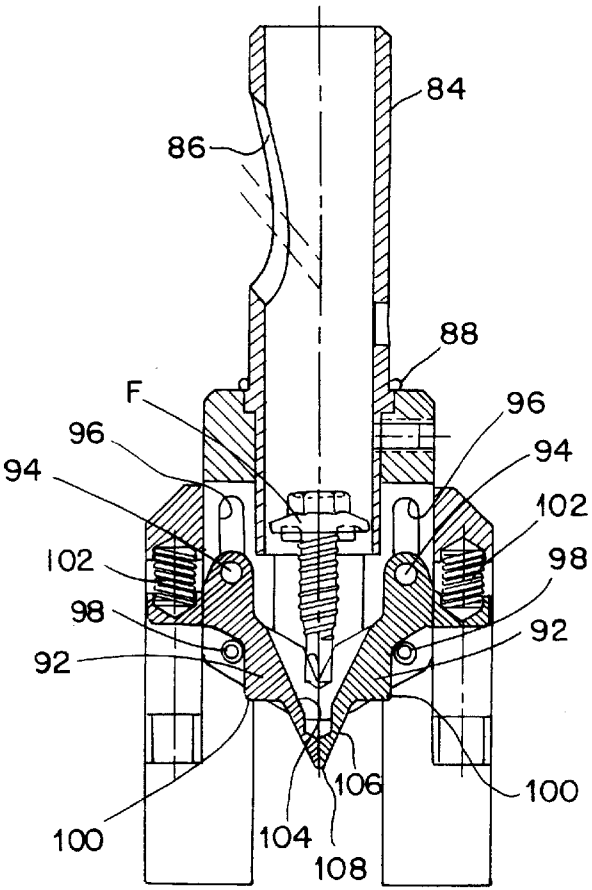
FIG. 5 is a cross-sectional view of the nosepiece assembly taken along line 5—5 of FIG. 4.
Figure 4:
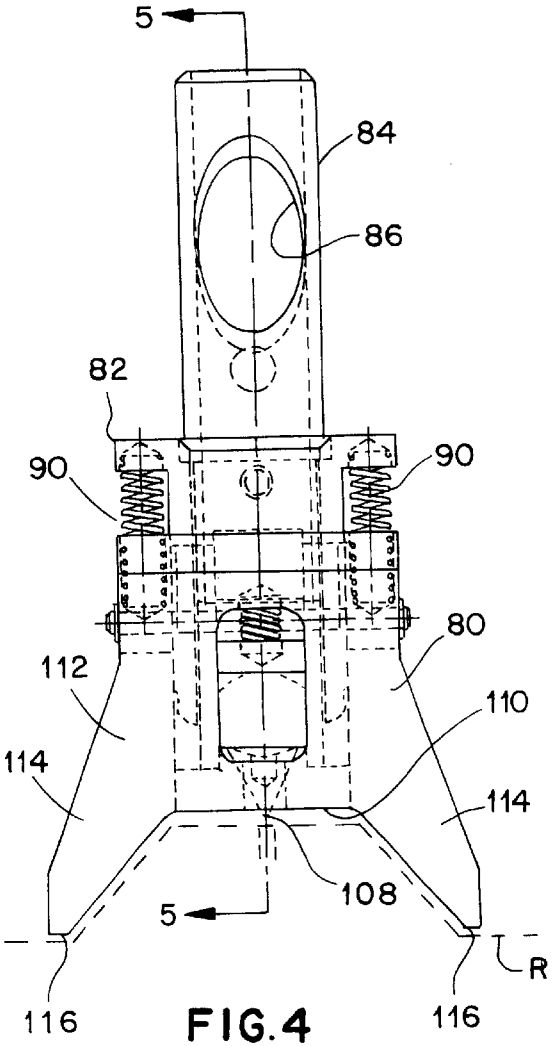
FIG. 4 is a side view of the nosepiece assembly of FIG. 3.
Figure 3:
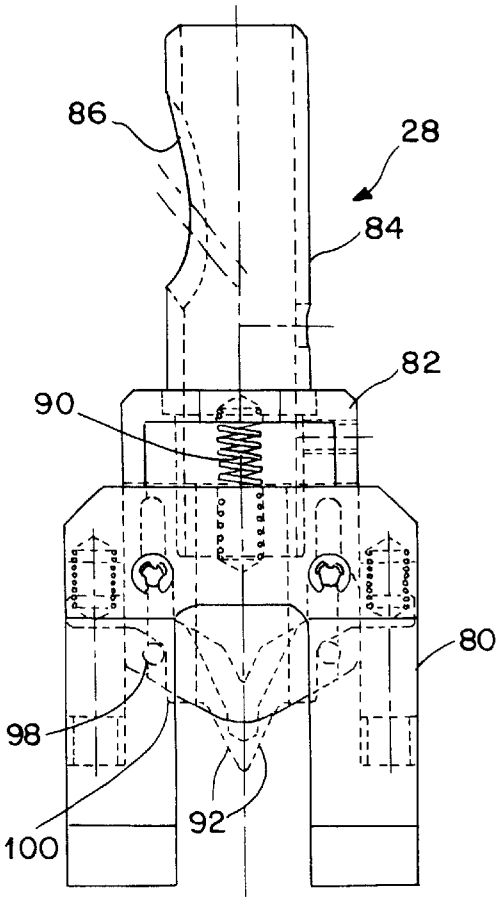
FIG. 3 is a front view of one embodiment of a nosepiece assembly for use with the fastener driving tool, which nosepiece assembly embodies the principles of the present invention.

Referring now to FIGS. 3–5, there is shown one embodiment of a fastener receiving member or nosepiece assembly 28 embodying the principles of the present invention. The nosepiece assembly 28 is mounted to the fastener discharge end of the tool 10 at about the juncture 24 of the feed tube 26 and the lower tube 20. The nosepiece 28 is configured to receive a fastener F and to guide and align the fastener F into proper position to be driven.

The nosepiece 28 includes a lower guide or cradle 80, an upper guide 82 and a nosepiece tube 84. The cradle 80 is configured to rest on the roof panel (as indicated at R in FIG. 4) to straddle a corrugation. The upper guide 82 and nosepiece tube 84 are fixedly mounted to each other. The nosepiece tube 84 inserts into the distal end 22 of the lower tube 20 and includes an elongated opening 86 in the side wall of the tube 84 that aligns with the feed tube 26 so that fasteners F fed from the feed tube F are directed into the nosepiece tube 84. An O-ring 88 can be positioned on the nosepiece tube 84, between the upper guide 82 and the lower tube distal end 22 to reduce rattle of the tool 10 during use.

The upper guide 82 and nosepiece tube 84 are mounted to the cradle 80 for reciprocal movement within the cradle 80 between a loading position and a driving position, which positions correspond to the loading and driving positions of the tool 10, generally. A pair of springs 90 are disposed between the upper guide 82 and the cradle 80 to bias the upper guide 82 into the loading position.

A pair of opposing jaw elements 92 are pivotally mounted to the cradle 80. The jaws 92, when in a closed position, support the fastener F and when open, pivot outwardly to permit driving the fastener F into the workpiece (e.g., roof panel R). A pair of pivot pins 94 extend through the cradle 80 for pivotal movement of the jaws 92.

The upper guide 82, as set forth above, is mounted to the cradle 80 for reciprocal movement. A pair of elongated slots 96 are formed in the upper guide 82, through which the pivot pins 94 traverse. In this manner, the upper guide 82 reciprocates within the cradle 80, along the pivot pins 94, independent of the jaws 92.

The upper guide 82 further includes a pair of roll pins 98 mounted thereto that are configured to cooperate with the jaws 92. The roll pins 98 move with the upper guide 82 to move into and out of interfering engagement with the jaws 92. To this end, when the upper guide 82 is in a retracted position and the jaws 92 are closed, the roll pins 98 engage a camming shoulder 100 on each respective jaw 92 to maintain or lock the jaws 92 closed. When the upper guide 82 is urged downwardly to the driving position, the roll pins 98 are moved out of engagement with the camming shoulders 100 which permits the jaws 92 to pivot outwardly to open. The jaws 92 are, however, biased closed by a pair of return springs 102. The force of the fastener F against an inner surface 104 of the jaws 92 urges the jaws 92 open when the roll pins 98 are disengaged from their respective jaw camming shoulders 100. In this manner, the jaws 92 are maintained closed until they are "unlocked" by movement of the roll pins 98 off of the camming shoulders 100 (by downward force on the upper guide 82) and urged or forced open by the fastener F being driving through the jaws 92, out of the nosepiece 28 and into the workpiece.

As can be seen from FIG. 5, the jaws 92 are configured having a split arrangement. Each half of the split jaw arrangement defines one-half of a downwardly oriented conical element 106. The conical element 106 halves, when mated, terminate at a nadir 108. The nadir 108 is disposed slighting below an upper inside surface 110 of the cradle 80 so that as the tool 10 is moved along the surface of the roof panel R, the nadir 108 will essentially drop into the preformed hole (if provided) in the roof panel R. As will be recognized by those skilled in the art, this provides rapid and sure tool 10 alignment over a desired location on the roof panel R.

The cradle 80 includes a central, main body portion 112 and a pair of legs 114 diverging downwardly and outwardly therefrom. The cradle 80 is configured to rest on and engage a corrugation of the metal roof panel R, with the upper inside surface 110 of the cradle 80 resting on the peak of the corrugation, the legs 114 extending downwardly along the sides of the corrugation, and the leg bases 116 resting on or in the valleys of adjacent corrugations. As such, the cradle 80 is held secure against the deck panel R corrugation. In this manner, the cradle 80 is self-centering along the corrugation peak.

The present cradle 80 provides for readily aligning the tool 10 along the corrugation peak so that the fasteners F are properly driven into the roof panel R. In use, the tool 10 is slid along the roof panel R with the cradle 80 engaging a corrugation peak. When traversing the tool along the roof panel R, it is in the loading condition with the tubes 14, 20 and nosepiece 28 retracted. When the jaw nadir 108 "falls" into a roof panel R hole, the tool 10 is stood upright and a fastener F is fed into the feed tube 26. The fastener F is fed by gravity to the nosepiece 28. A downward pressure is then applied to the driver 12 handle. The downward pressure moves the upper and lower tubes 14, 20 into the contracted or driving position which engages the fastener engaging element 34 with the fastener F head. Continued downward pressure urges the nosepiece assembly upper guide 82 down to "unlock" the jaws 92. As further downward pressure is applied to the driver 12 handle and as the driver 12 is actuated, the fastener F is urged though the jaws 92 and is driven into the roof panel R.

Those skilled in the art will recognize that the types of metal roof systems available vary. To this end, not all roof panels are formed wit preformed openings along the panel corrugation peaks. As such, the present tool 10 can be use such that the nadir 108 is used to position the tool 10 along the corrugation peak, at a desired location on the roof panel R.

Figure 7:
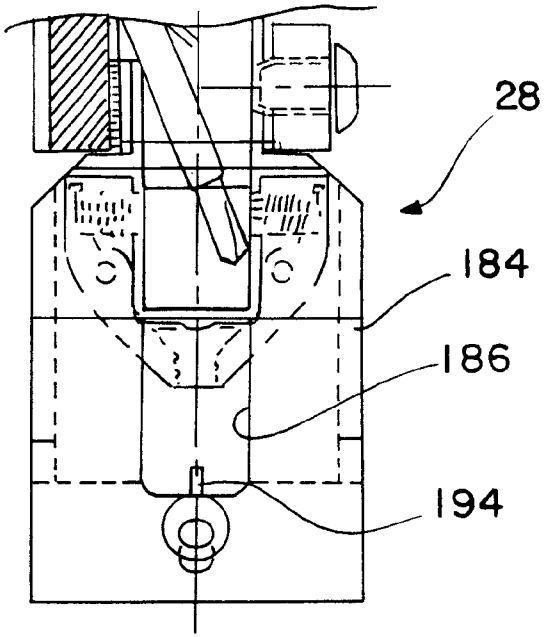
FIG. 7 is a front view of the cradle of FIG. 6.
Figure 6:
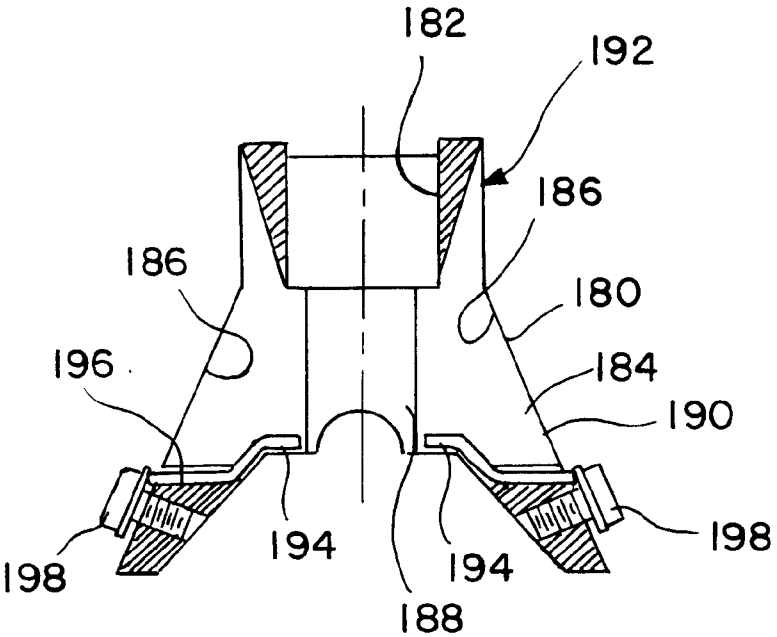
FIG. 6 is a side view of another nosepiece assembly illustrating and alternate nosepiece cradle.
Figure 2A:
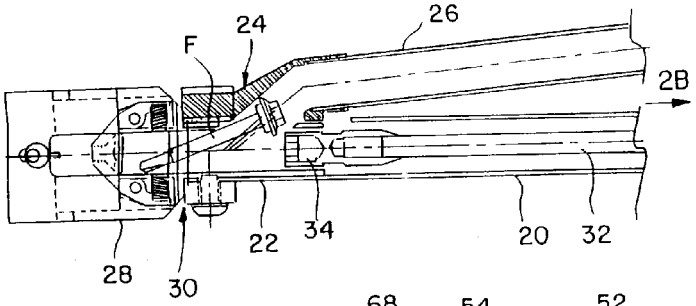
Figure 2B:
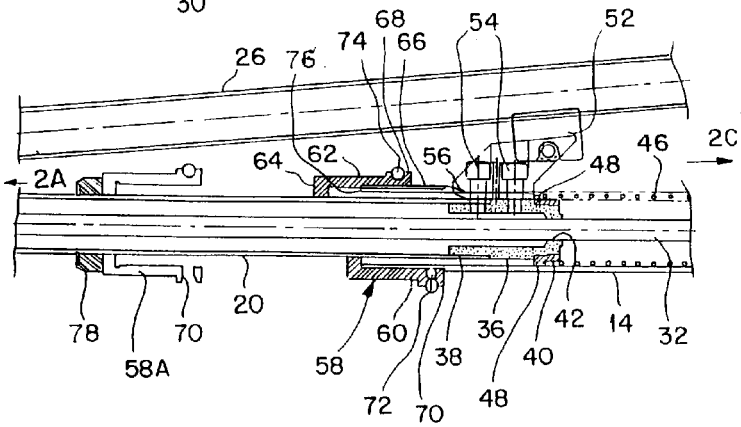
Figure 2C:
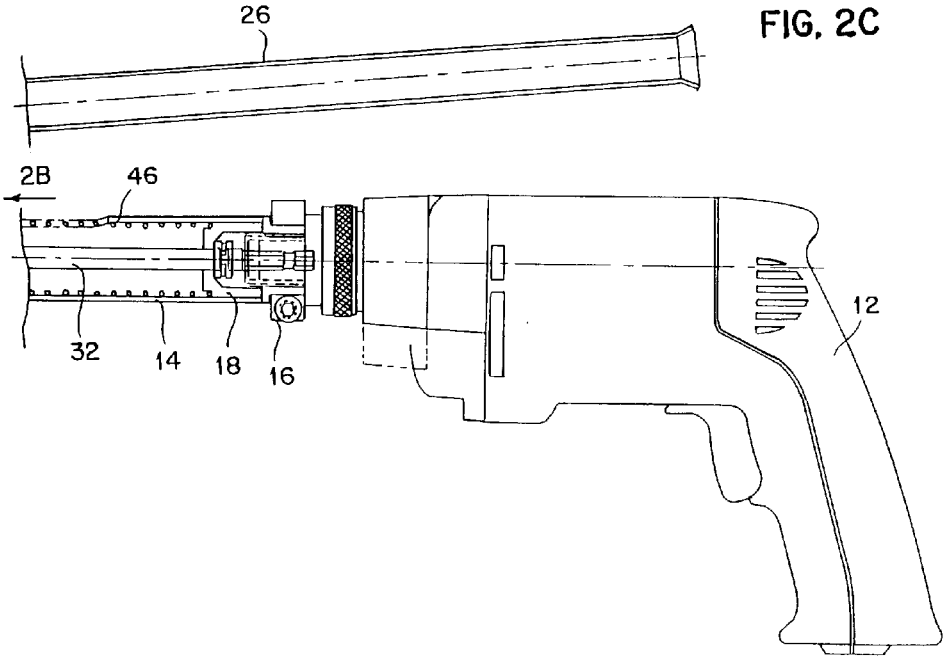

An alternate cradle 180 is illustrated in FIGS. 6–7. This cradle 180 can be used with or without the nosepiece assembly illustrated in FIGS. 3–5. The cradle 180 includes a central, elongated bore 182 through which the fastener F travels as it is driven from the tool 10. As seen in FIG. 6, each of the legs 184 includes an opening or viewing window 186 therein. The viewing windows 186 each extend through inner and outer surfaces 188, 190 of the legs 184 and through a portion of the main body 192. To this end, when the cradle 180 is resting on a corrugation of the roof panel R the corrugation peak is readily visible through the viewing windows 186. In addition, in that the present tool 10 is configured for use by an operator standing erect or relatively erect, the viewing window 186 is configured so that central portion of the corrugation peak is readily viewed by the operator standing slightly off-center of the tool 10 when it is positioned for use. As such, there is no longer a need for an operator to constantly crouch and stand while driving fasteners F into the roof deck R.

The cradle 180 is further provided with aligning markers 194, such as styli or engraved indicia to align the cradle 180 and thus the tool 10 over the desired location on the panel R (e.g., over the preformed roof panel R holes). The styli 194 can be, for example, wire 196 mounted to the cradle legs 184 by screws, bolts or other mechanical fasteners, such as indicated at 198. The aligning markers 194 permit properly visually aligning the tool 10 on the roof panel R (e.g., immediately above the roof panel R hole) to properly drive the fastener F. Similar to the cradle 80 illustrated in FIGS. 3–5, this embodiment of the cradle 180 straddles the roof panel R corrugation and is thus self-centering over the roof panel R corrugation.

Those skilled in the art will recognize that a variety of different types of aligning markers 194 and aligning devices can be used to assure that the tool is properly aligned on the roof panel R. All such aligning devices are within the scope and spirit of the present invention.

In the present disclosure, the words "a" or "an" are to be taken to include both the singular and the plural. Conversely, any reference to plural items shall, where appropriate, include the singular.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

What is claimed is:

1. A fastener driving tool for driving fasteners into a workpiece, for use by an operator in a substantially erect position, the tool configured for use on an associated roof deck panel to drive fasteners into the panel, the panel having a corrugation-like profile defining a peak, a pair of valleys adjacent to the peak and respective walls extending between the peak and the adjacent valleys, the fastener tool comprising:

a driver having a driver shaft extending therefrom, a first extension member operably connected to the driver;

a second extension member operably connected to the first extension member, the second extension member slidingly engaged with the first extension member between a loading position and a driving position;

a bearing assembly operably connecting the first and second extension members, the bearing assembly formed from a non-metallic, low-friction material, a portion of the bearing assembly mounted to one of the first and second extension members for sliding engagement with the other extension member and disposed to prevent direct contact of the first and second extension members with one another; and a fastener receiving member for receiving fasteners when in the loading position and for supporting and releasing the fasteners when in the driving position, the fastener receiving member being mounted to the second extension member, the fastener receiving member including a cradle having a main body portion and a pair of legs extending from the main body portion diverging downwardly and outwardly from the main body portion symmetrical to one another, the main body defining an upper inside surface extending between and contiguous with the legs and an opening through the main body portion for passage of a fastener therethrough, wherein the cradle is configured for positioning on the panel, straddling the peak with the upper inside surface resting adjacent the peak and the legs extending into the valleys for aligning the opening in the main body portion along the roof panel corrugation.

2. The fastener driving tool in accordance with claim 1 wherein the bearing assembly includes an upper tube bearing mounted to a lower end of the upper tube for slidingly engaging the lower tube, the upper tube bearing including a sleeve portion mounted to the upper tube and a bearing portion extending transverse to and inwardly of the sleeve portion for contact with the lower tube.

3. The fastener driving tool in accordance with claim 2 including a driver shaft guide mounted to the lower tube at about an upper end thereof, the driver shaft guide carrying an upper tube bearing surface for slidingly engaging the upper tube, the upper tube bearing surface and the upper tube bearing maintain the upper and lower tubes concentric with one another.

4. The fastener driving tool in accordance with claim 1 wherein the cradle includes a jaw assembly having first and second jaw elements pivotally mounted to the cradle, the jaw elements being movable between a closed position wherein the jaw elements abut one another and support a fastener and an open position wherein the jaw elements are pivoted away from one another by the fastener driven therethrough, the jaw elements mounted to the cradle by pivot pins.

5. The fastener driving tool in accordance with claim 4 including an upper guide mounted to the cradle, the upper guide being movable between a loading position corresponding to the closed position of the jaw elements and a driving position corresponding to the open position of the jaw elements, the upper guide including a locking member for interfering with pivoting of the jaw elements when the upper guide is in the loading position and for disengaging the jaw elements when the upper guide is in the driving position.

6. The fastener driving tool in accordance with claim 4 wherein the jaw elements are biased closed.

7. The fastener driving tool in accordance with claim 4 wherein the jaw elements each define one-half of a cone, and wherein the jaw elements define a nadir when engaged with one another.

8. The fastener driving tool in accordance with claim 7 wherein the nadir extends through the cradle opening beyond the upper inside surface thereof.

9. A fastener driving tool for driving fasteners into a workpiece, for use by an operator m a substantially erect position, the tool comprising:

a driver having a driver shaft extending therefrom;

a first extension member operably connected to the driver;

a second extension member operably connected to the first extension member, the second extension member slidingly engaged with the first extension member between a loading position and a driving position;

a fastener receiving member for receiving fasteners when the first and second extension members are in the loading position and for supporting and releasing the fasteners when the first and second extension members are in the driving position; and a bearing assembly operably connected to the first and second extension members, the bearing assembly formed from a non-metallic, low-friction material, a first portion of the bearing assembly mounted to the first extension member for sliding engagement with the second extension member and a second portion of the bearing assembly mounted to the second extension member for sliding engagement with the first extension member, the first and second portions of the bearing assembly disposed to prevent direct contact of the first and second extension members with one another, wherein the first extension member bearing includes a sleeve portion threadedly engaging the first extension member for mounting thereto, and wherein the sleeve portion includes an outer collar having a plurality of resilient spherical elements positioned therein and a retaining member positioned over the spherical elements to maintain the bearing threadedly engaged with the first extension member at a predetermined location.

10. The fastener driving tool in accordance with claim 9 wherein the first extension member is mounted to the driver and defines an upper tube and the second extension member has the fastener receiving member mounted thereto and defines a lower tube, and wherein the bearing assembly includes an upper tube bearing mounted to the upper tube about a lower end thereof for slidingly engaging an outside surface of the lower tube, and a lower tube bearing mounted to the lower tube about an upper end thereof for slidingly engaging an inner surface of the upper tube.

11. The fastener driving tool in accordance with claim 10 wherein the upper tube bearing includes a sleeve portion mounted to the upper tube and a bearing portion extending transverse to and inwardly of the sleeve portion for contact with the lower tube.

12. The fastener driving tool in accordance with claim 11 wherein the upper tube bearing is mounted to a lower end of the upper tube and engages the lower tube intermediate ends thereof.

13. The fastener driving tool in accordance with claim 10 wherein the lower tube includes a stop mounted thereto for engaging the upper tube bearing to limit a length of travel of the upper and lower tubes relative to one another during sliding engagement of the tubes.

14. The fastener driving tool in accordance with claim 10 wherein the bearing assembly includes an upper tube bearing surface mounted to the lower tube at about an upper end thereof for slidingly engaging the upper tube.

15. The fastener driving tool in accordance with claim 14 including a driver shaft guide configured to carry the upper tube bearing surface, wherein the upper tube bearing surface and the upper tube bearing maintain the upper and lower tubes concentric with one another.

16. A fastener driving tool for driving fasteners into a workpiece, for use by an operator in a substantially erect position, the tool configured for use on an associated roof deck panel to drive fasteners into the panel, the panel having a corrugation-like profile defining a peak, a pair of valleys adjacent to the peak and respective walls extending between the peak and the adjacent valleys, the fastener tool comprising:

a driver having a drive shaft extending therefrom;

a fastener receiving member for receiving fasteners when in a loading position and for supporting and releasing the fasteners when in a driving position, the fastener receiving member including a cradle having a main body portion and a pair of legs extending from the main body portion diverging downwardly and outwardly from the main body portion symmetrical to one another, the main body defining an upper inside surface extending between and contiguous with the legs and an opening through the main body portion for passage of a fastener therethrough, wherein the cradle is configured for positioning on the panel, straddling the peak with the upper inside surface resting adjacent the peak and the legs extending into the valleys for aligning the opening in the main body portion with the roof panel peak.

17. The fastener driving tool in accordance with claim 16 including a viewing opening extending through one of the legs and an aligning marker operably associated with the viewing opening for aligning the fastener driving tool with the roof panel peak.

18. The fastener driving tool in accordance with claim 17 wherein the aligning marker includes a stylus extending inwardly of the one of the legs.

19. The fastener driving tool in accordance with claim 17 wherein the aligning marker includes indicia on the one of the legs.

20. The fastener driving tool in accordance with claim 16 wherein the cradle includes a jaw assembly having first and second jaw elements pivotally mounted to the cradle, the jaw elements pivotal between a closed position wherein the jaw elements abut one another and support a fastener and an open position wherein the jaw elements are pivoted away from one another by the fastener driven therethrough, the jaw elements mounted to the cradle by pivot pins.

21. The fastener driving tool in accordance with claim 20 including an upper guide mounted to the cradle, the upper guide being movable between a loading position corresponding to the closed position of the jaw elements and a driving position corresponding to the open position of the jaw elements, the upper guide including a locking member for interfering with pivoting of the jaw elements when the upper guide is in the loading position and for disengaging the jaw elements when the upper guide is in the driving position.

22. The fastener driving tool in accordance with claim 21 wherein the jaw elements are biased to the closed position.

23. The fastener driving tool in accordance with claim 20 wherein the jaw elements each define one-half of a cone, and wherein the jaw elements define a nadir when engaged with one another.

24. The fastener driving tool in accordance with claim 23 wherein the nadir extends through the cradle opening beyond the upper inside surface thereof.

25. A fastener receiving member for use with an associated fastener driving tool usable by an operator in a substantially erect position, the associated driving tool configured for use on an associated roof deck panel to drive fasteners into the panel, the panel having a corrugation-like profile defining a peak, a pair of valleys adjacent to the peak and respective walls extending between the peak and the adjacent valleys, the fastener receiving member mounted to the fastener driving tool for receiving and delivering the fastener to the roof deck panel, the fastener receiving member comprising:

a cradle having a main body portion; and a pair of legs extending from the main body portion diverging downwardly and outwardly from the main body portion symmetrical to one another, the main body defining an upper inside surface extending between and contiguous with the legs and an opening through the main body portion for passage of the fastener therethrough, wherein the cradle is configured for positioning on the panel, straddling the peak with the upper inside surface resting adjacent the peak and the legs extending into the valleys for aligning the opening in the main body portion along the roof panel corrugation.

26. The fastener receiving member in accordance with claim 25 wherein the cradle includes a jaw assembly having first and second jaw elements pivotally mounted to the cradle, the jaw elements being movable between a closed position wherein the jaw elements abut one another and support a fastener and an open position wherein the jaw elements are pivoted away from one another by the fastener driven therethrough, the jaw elements mounted to the cradle by pivot pins.

27. The fastener receiving member in accordance with claim 25 including an upper guide mounted to the cradle, the upper guide being movable between a loading position corresponding to the closed position of the jaw elements and a driving position corresponding to the open position of the jaw elements, the upper guide including a locking member for interfering with pivoting of the jaw elements when the upper guide is in the loading position and for disengaging the jaw elements when the upper guide is in the driving position.

28. The fastener receiving member in accordance with claim 27 wherein the jaw elements are biased closed.

29. The fastener receiving member in accordance with claim 26 wherein the jaw elements each define one-half of a cone, and wherein the jaw elements define a nadir when engaged with one another.

30. The fastener receiving member in accordance with claim 29 wherein the nadir extends through the cradle opening beyond the upper inside surface thereof.

31. The fastener receiving member in accordance with claim 25 including a viewing opening extending through at least one of the legs and an aligning marker operably associated with the viewing opening for aligning the fastener driving tool with the roof panel peak.

32. The fastener receiving member in accordance with claim 31 wherein the aligning marker includes a stylus extending inwardly of the one of the legs.

33. The fastener receiving member in accordance with claim 31 wherein the aligning marker includes indicia on the one of the legs.

34. A fastener driving tool for driving fasteners into a workpiece, for use by an operator in a substantially erect position, the tool comprising:

a driver having a driver shaft extending therefrom;

an upper tube operably connected to the driver;

a lower tube slidingly engagable with the upper tube between a loading position and a driving position;

a bearing assembly operably connected to the upper and lower tubes, the bearing assembly formed from a non-metallic, low-friction material, the bearing assembly including an upper tube bearing having a sleeve portion, the upper tube bearing mounted to a lower end of the upper tube for slidingly engaging the lower tube, and a lower tube bearing mounted to an upper end of the lower tube for slidingly engaging the upper tube, wherein the sleeve portion includes an outer collar having a plurality of resilient spherical elements positioned therein and a retaining member positioned over the spherical elements to maintain the bearing threadedly engaged with the upper tube at a predetermined location.

35. The fastener driving tool in accordance with claim 34 wherein the upper tube bearing engages the lower tube intermediate ends thereof.

36. The fastener driving tool in accordance with claim 34 wherein the lower tube includes a stop mounted thereto for engaging the upper tube bearing to limit a length of travel of the upper and lower tubes relative to one another during sliding engagement of the tubes.

37. The fastener driving tool in accordance with claim 34 wherein the bearing assembly includes an a lower tube bearing surface mounted to the lower tube at about an upper end thereof for slidingly engaging the upper tube.

38. The fastener driving tool in accordance with claim 31 including a driver shaft guide configured to carry the lower tube bearing surface, wherein the upper tube bearing surface and the lower tube bearing maintain the upper and lower tubes concentric with, and radially spaced from, one another.

39. The fastener driving tool in accordance with claim 34 wherein the upper tube bearing sleeve portion threadedly engages the upper tube for mounting thereto.

40. The fastener driving tool in accordance with claim 34 wherein the upper tube bearing includes a sleeve portion mounted to the upper tube and a bearing portion extending transverse to and inwardly of the sleeve portion for contact with the lower tube, the upper tube bearing portion maintaining the upper and lower tubes concentric with, and radially spaced from, one another.

* * * * *

UNITED STATES PATENT AND TRADEMARK OFFICE

CERTIFICATE OF CORRECTION

PATENT NO. : 6,729,522 B2
DATED : May 4, 2004
INVENTOR(S) : Hempfling et al.

It is certified that error appears in the above-identified patent and that said Letters Patent is hereby corrected as shown below:

Drawings,
Replace Sheet 2 of the drawings with Sheet 2 (to correct an error in Figure 2B) submitted herewith.

Signed and Sealed this

Twenty-fourth Day of August, 2004

JON W. DUDAS
*Director of the United States Patent and Trademark Office*